US008751224B2

(12) United States Patent
Herve et al.

(10) Patent No.: US 8,751,224 B2
(45) Date of Patent: Jun. 10, 2014

(54) COMBINED MICROPHONE AND EARPHONE AUDIO HEADSET HAVING MEANS FOR DENOISING A NEAR SPEECH SIGNAL, IN PARTICULAR FOR A "HANDS-FREE" TELEPHONY SYSTEM

(75) Inventors: Michael Herve, Paris (FR); Guillaume Vitte, Paris (FR)

(73) Assignee: Parrot, Paris (FR)

( * ) Notice: Subject to any disclaimer, the term of this patent is extended or adjusted under 35 U.S.C. 154(b) by 254 days.

(21) Appl. No.: 13/450,361

(22) Filed: Apr. 18, 2012

(65) Prior Publication Data

US 2012/0278070 A1 Nov. 1, 2012

(30) Foreign Application Priority Data

Apr. 26, 2011 (FR) ..... 11 53572

(51) Int. Cl.
*G10L 21/00* (2013.01)

(52) U.S. Cl.
USPC ..... 704/226; 704/205; 704/233

(58) Field of Classification Search
CPC ..... G10L 12/0208; G10L 25/78
USPC ..... 704/226, 205, 233
See application file for complete search history.

(56) References Cited

U.S. PATENT DOCUMENTS

| | | | | |
|---|---|---|---|---|
| 7,383,181 | B2 * | 6/2008 | Huang et al. | 704/231 |
| 7,930,178 | B2 * | 4/2011 | Zhang et al. | 704/234 |
| 2011/0096939 | A1 * | 4/2011 | Ichimura | 381/74 |
| 2011/0135106 | A1 * | 6/2011 | Yehuday et al. | 381/71.6 |
| 2012/0310637 | A1 * | 12/2012 | Vitte et al. | 704/226 |
| 2013/0051585 | A1 * | 2/2013 | Karkkainen et al. | 381/151 |

FOREIGN PATENT DOCUMENTS

| | | |
|---|---|---|
| EP | 0683621 A2 | 5/1995 |
| JP | 08214391 | 8/1996 |
| JP | 2000261534 | 9/2000 |
| WO | 0021194 | 4/2000 |

* cited by examiner

*Primary Examiner* — Vincent P Harper
(74) *Attorney, Agent, or Firm* — Haverstock & Owens LLP

(57) ABSTRACT

The headset comprises: a physiological sensor suitable for being coupled to the cheek or the temple of the wearer of the headset and for picking up non-acoustic voice vibration transmitted by internal bone conduction; lowpass filter means for filtering the signal as picked up; a set of microphones picking up acoustic voice vibration transmitted by air from the mouth of the wearer of the headset; highpass filter means and noise-reduction means for acting on the signals picked up by the microphones; and mixer means for combining the filtered signals to output a signal representative of the speech uttered by the wearer of the headset. The signal of the physiological sensor is also used by means for calculating the cutoff frequency of the lowpass and highpass filters and by means for calculating the probability that speech is absent.

9 Claims, 2 Drawing Sheets

COMBINED MICROPHONE AND EARPHONE AUDIO HEADSET HAVING MEANS FOR DENOISING A NEAR SPEECH SIGNAL, IN PARTICULAR FOR A "HANDS-FREE" TELEPHONY SYSTEM

FIELD OF THE INVENTION

The invention relates to an audio headset of the combined microphone and earphone type.

Such a headset may be used in particular for communications functions such as "hands-free" telephony functions, in addition to listening to an audio source (e.g. music) coming from equipment to which the headset is connected.

BACKGROUND OF THE INVENTION

In communications functions, one of the difficulties is to ensure sufficient intelligibly of the signal picked up by the microphone, i.e. the signal representing the speech of the near speaker (the wearer of the headset).

The headset may be used in an environment that is noisy (subway, busy street, train, etc.), such that the microphone picks up not only speech from the wearer of the headset, but also interfering noises from the surroundings.

The wearer may be protected from these noises by the headset, particularly if it is of a kind comprising closed earpieces that isolate the ears from the outside, and even more so if the headset is provided with "active noise control". In contrast, the remote listener (i.e. the party at the other end of the communication channel) will suffer from the interfering noises picked up by the microphone, which noises are superposed on and interfere with the speech signal from the near speaker (the wearer of the headset).

In particular, certain speech formants that are essential for understanding the voice are often buried in noise components that are commonly encountered in everyday environments, which components are for the most part concentrated at low frequencies.

In such a context, the general problem of the invention is to provide noise reduction that is effective, enabling a voice signal to be delivered to the remote speaker that is indeed representative of the speech uttered by the near speaker, which signal has had removed therefrom the interference components from external noises present in the environment of the near speaker.

An important aspect of this problem is the need to play back a speech signal that is natural and intelligible, i.e. that is not distorted and that has a frequency range that is not cut down by the denoising processing.

One of the ideas on which the invention is based consists in picking up certain voice vibrations by means of a physiological sensor applied against the cheek or the temple of the wearer of the headset, so as to access new information relating to speech content. This information is then used for denoising and also for various auxiliary functions that are explained below, in particular for calculating a cutoff frequency of a dynamic filter.

When a person is uttering a voiced sound (i.e. producing a speech component that is accompanied by vibration of the vocal cords), the vibration propagates from the vocal cords to the pharynx and to the mouth-and-nose cavity, where it is modulated, amplified, and articulated. The mouth, the soft palate, the pharynx, the sinuses, and the nasal cavity form a resonance box for the voiced sound, and since their walls are elastic, they vibrate in turn, and this vibration is transmitted by internal bone conduction and is perceptible from the cheek and from the temple.

By its very nature, such voice vibration from the cheek and from the temple presents the characteristic of being corrupted very little by noise from the surroundings: in the presence of external noise, the tissues of the cheek or of the temple vibrate very little, and this applies regardless of the spectral composition of the external noise.

OBJECT AND SUMMARY OF THE INVENTION

The invention relies on the possibility of picking up such voice vibration that is free of noise by means of a physiological sensor applied directly against the cheek or the temple. Naturally, the signals as picked up in this way are not properly speaking "speech", since speech is not made up solely of voiced sounds, given that it contains components that do not stem from the vocal cords: for example, frequency content is much richer with sounds coming from the throat and issuing from the mouth. Furthermore, internal bone conduction and passage through the skin has the effect of filtering out certain voice components.

Nevertheless, the signal is indeed representative of voice content that is voiced, and can be used effectively for reducing noise and/or for various other functions.

Furthermore, because of the filtering that occurs as a result of vibration propagating as far as the temple, the signal picked up by the physiological sensor is usable only for low frequencies. However the noises that are generally encountered in an everyday environment (street, subway, train, . . . ) are concentrated for the most part at low frequencies, so there is a considerable advantage in terms of reducing noise in having available a physiological sensor that delivers a low-frequency signal that is naturally free of the interfering components resulting from noise (where this is not possible with a conventional microphone).

More precisely, the invention proposes performing denoising of the near speech signal by using a combined microphone and earphone headset that comprises in conventional manner earpieces connected together by a headband and each having a transducer for sound reproduction of an audio signal housed in a shell that is provided with an ear-surrounding cushion, and at least one microphone suitable for picking up the speech of the wearer of the headset.

In a manner characteristic of the invention, this combined microphone and earphone headset includes means for denoising a near speech signal uttered by the wearer of the headset, which means comprise: a physiological sensor incorporated in the ear-surrounding cushion and placed in a region thereof that is suitable for coming into contact with the cheek or the temple of the wearer of the headset in order to be coupled thereto and pick up non-acoustic voice vibration transmitted by internal bone conduction, the physiological sensor delivering a first speech signal; a microphone set, comprising the microphone(s) suitable for picking up the acoustic voice vibration that is transmitted through the air from the mouth of the wearer of the headset, this microphone set delivering a second speech signal; means for denoising the second speech signal; and mixer means for combining the first and second speech signals, and for outputting a third speech signal representative of the speech uttered by the wearer of the headset.

Preferably, the combined microphone and earphone headset comprises: lowpass filter means for filtering the first speech signal before it is combined by the mixer means, and/or highpass filter means for filtering the second speech signal before it is denoised and combined by the mixer means.

Advantageously, the lowpass and/or highpass filter means comprise filters of adjustable cutoff frequency; and the headset includes cutoff frequency calculation means operating as a function of the signal delivered by the physiological sensor. The cutoff frequency calculation means may in particular comprise means for analyzing the spectral content of the signal delivered by the physiological sensor, and suitable for determining the cutoff frequency as a function of the relative levels of the signal-to-noise ratios as evaluated in a plurality of distinct frequency bands of the signal delivered by the physiological sensor.

Preferably, the means for denoising the second speech signal are non-frequency noise-reduction means that make use, in one particular embodiment of the invention, of the microphone set that has two microphones, and of a combiner suitable for applying a delay to the signal delivered by one of the microphones and for subtracting the delayed signal from the signal delivered by the other microphone.

In particular, the two microphones may be in alignment in a linear array having a main direction directed towards the mouth of the wearer of the headset.

Also preferably, means are provided for denoising the third speech signal as delivered by the mixer means, in particular frequency noise-reduction means.

According to an original aspect of the invention, there are provided means receiving as input the first and third speech signals and performing intercorrelation between them, and delivering as output a signal representative of the probability of speech being present as a function of the result of the intercorrelation. The means for denoising the third speech signal receive as input this signal representative of the probability that speech is present, and they are suitable selectively for:

i) performing noise reduction differently in different frequency bands as a function of the value of the signal representing the probability that speech is present; and
ii) performing maximum noise reduction in all frequency bands in the absence of speech.

There may also be provided post-processing means suitable for performing equalization selectively in different frequency bands in the portion of the spectrum corresponding to the signal picked up by the physiological sensor. These means determine an equalization gain for each of the frequency bands, the gain being calculated on the basis of the respective frequency coefficients of the signals delivered by the microphone(s) and the signals delivered by the physiological sensor, as considered in the frequency domain.

They also perform smoothing of the calculated equalization gain over a plurality of successive signal frames.

BRIEF DESCRIPTION OF THE DRAWINGS

There follows a description of an embodiment of the device of the invention with reference to the accompanying drawings in which the same numerical references are used from one figure to another to designate elements that are identical or functionally similar.

MORE DETAILED DESCRIPTION

Figure 1:
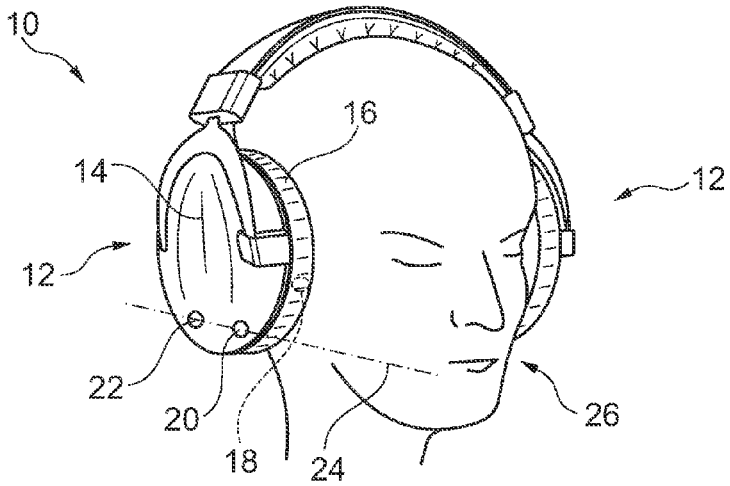
FIG. 1 is a general view of a headset of the invention, placed on the head of a user.

In FIG. 1, reference 10 is an overall reference for the headset of the invention, which comprises two earpieces 12 held together by a headband. Each of the earpieces is preferably constituted by a closed shell 12 housing a sound reproduction transducer and pressed around the user's ear with an isolating cushion 16 interposed to isolate the ear from the outside.

In a manner characteristic of the invention, the headset is provided with a physiological sensor 18 for picking up the vibration produced by a voiced signal uttered by the wearer of the headset, which vibration may be picked up via the cheek or the temple. The sensor 18 is preferably an accelerometer incorporated in the cushion 16 so as to press against the user's cheek or temple with the closest possible coupling. In particular, the physiological sensor may be placed on the inside face of the skin covering the cushion so that, once the headset is in position, the physiological sensor is pressed against the user's cheek or temple under the effect of a small amount of pressure that results from the material of the cushion being flattened, with only the skin of the cushion being interposed between the user and the sensor.

The headset also includes a microphone array or antenna, e.g. two omnidirectional microphones 20 and 22 placed on the shell of the earpiece 12. These two microphones comprise a front microphone 20 and a rear microphone 22 and they are omnidirectional microphones placed relative to each other in such a manner that they are in alignment along a direction 24 that is directed approximately towards the mouth 26 of the wearer of the headset.

Figure 2:
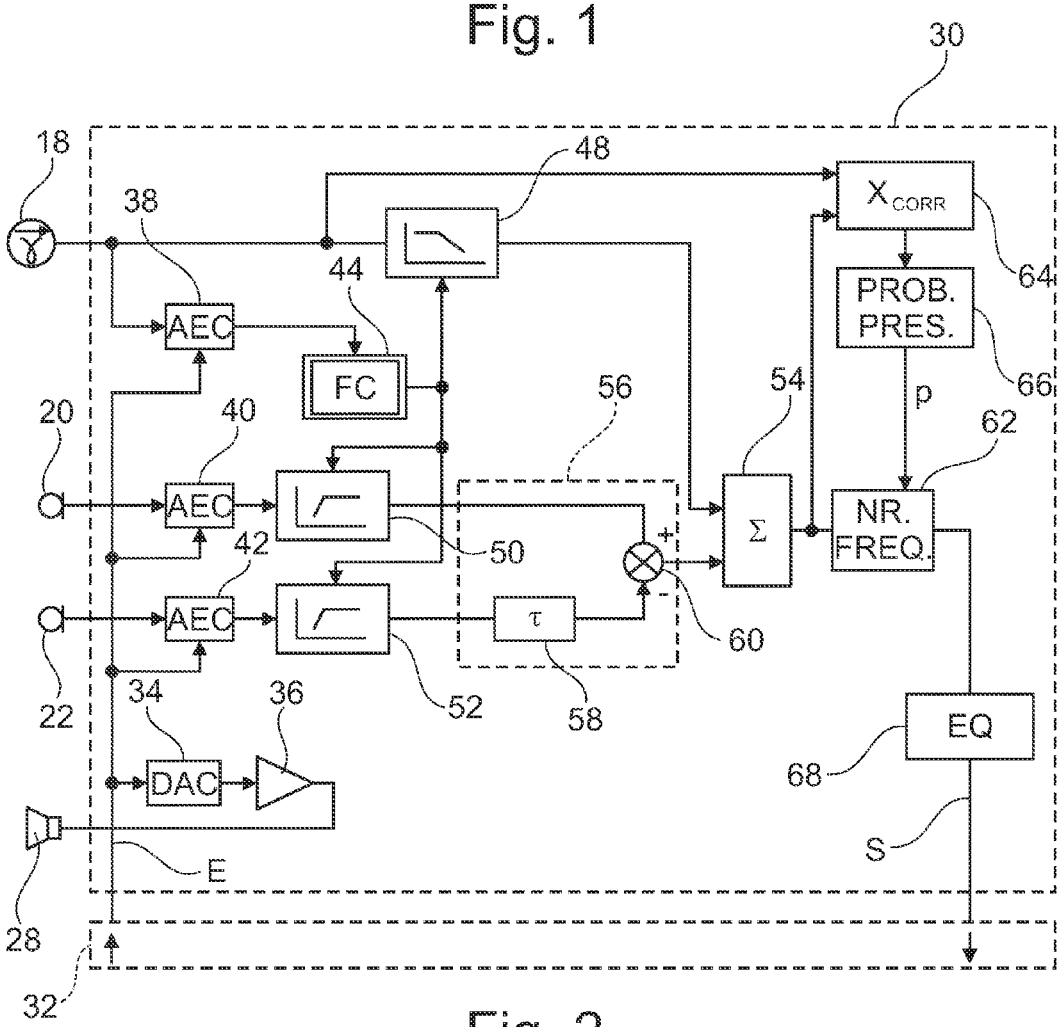
FIG. 2 is an overall block diagram explaining how the signal processing is performed that enables a denoised signal to be output that is representative of the speech uttered by the wearer of the headset.

FIG. 2 is a block diagram showing the various functional blocks used in the method of the invention, and how they interact.

The method of the invention is implemented by software means, that can be broken down and represented diagrammatically by various blocks 30 to 64 shown in FIG. 2. The processing is implemented in the form of appropriate algorithms executed by a microcontroller or a digital signal processor. Although for clarity of description these various processes are presented in the form of distinct blocks, they implement elements in common and in practice they correspond to a plurality of functions executed overall by the same software.

FIG. 2 shows the physiological sensor 18 and the front and rear omnidirectional microphones 20 and 22. Reference 28 designates the sound reproduction transducer placed inside the shell of the earpiece. These various elements deliver signals that are subjected to processing by the block referenced 30, which may be coupled to an interface 32 with communications circuits (telephone circuits) from which it receives as input E the sound that is to be reproduced by the transducer 28 (speech from the distant speaker during a telephone call, music source outside periods of telephone conversation), and to which it delivers on an output S a signal that is representative of the speech from the near speaker, i.e. the wearer of the headset.

The signal for reproduction that appears on the input E is a digital signal that is converted into an analog signal by a converter 34, and then amplified by an amplifier 36 for reproduction by the transducer 28.

There follows a description of the manner in which the denoised signal representative of speech from the near speaker is produced on the basis of the respective signals picked up by the physiological sensor 18 and by the microphones 20 and 22.

The signal picked up by the physiological sensor 18 is a signal that mainly comprises components in the lower region of the sound spectrum (typically in the range 0 to 1500 hertz (Hz)). As explained above, this signal is naturally not noisy.

The signals picked up by the microphones 20 and 22 are used mainly for the higher portion of the spectrum (above 1500 Hz), but these signals are very noisy and it is essential to perform strong denoising processing in order to eliminate the interfering noise components, which components may in certain environments be at a level such as to completely hide the speech signal picked up by the microphones 20 and 22.

The first step of the processing is anti-echo processing applied to the signals from the physiological sensor and from the microphones.

The sound reproduced by the transducer 28 is picked up by the physiological sensor 18 and by the microphones 20 and 22, thereby generating an echo that disturbs the operation of the system, and that must therefore be eliminated upstream.

This anti-echo processing is implemented by blocks 38, 40, and 42, each of these blocks having a first input receiving the signal delivered by a respective one of the sensor 18, and the microphones 20 and 22, and a second input receiving the signal reproduced by the transducer 28 (echo-generating signal), and it outputs a signal from which the echo has been eliminated for use in subsequent processing.

By way of example, the anti-echo processing is performed by processing with an adaptive algorithm such as that described in FR 2 792 146 A1 (Parrot S A), to which reference may be made for more details. It is an automatic echo canceling technique AEC consisting in dynamically defining a compensation filter that models the acoustic coupling between the transducer 28 and the physiological sensor 18 (or the microphone 20 or the microphone 22, respectively) by a linear transformation between the signal reproduced by the transducer 28 (i.e. the signal E applied as input to the blocks 38, 40, and 42) and the echo picked up by the physiological sensor 18 (or the microphone 20 or 22). This transformation defines an adaptive filter that is applied to the reproduced incident signal, and the result of this filtering is subtracted from the signal picked up by the physiological sensor 18 (or the microphone 20 or 22), thereby having the effect of canceling the major portion of the acoustic echo.

This modeling relies on searching for a correlation between the signal reproduced by the transducer 28 and the signal picked up by the physiological sensor 18 (or the microphone 20 or 22), i.e. an estimate of the impulse response of the coupling constituted by the body of the earpiece 12 supporting these various elements.

The processing is performed in particular by an adaptive algorithm of the affine projection algorithm (APA) type, that ensures rapid convergence, and that is well adapted to applications of the "hands-free type" in which voice delivery is intermittent and at a level that may vary rapidly.

Advantageously, the iterative algorithm is executed at a variable sampling rate, as described in above-mentioned FR 2 792 146 A1. With this technique, the sampling interval $\mu$ varies continuously as a function of the energy level of the signal picked up by the microphone, before and after filtering. This interval is increased when the energy of the signal as picked up is dominated by the energy of the echo, and conversely it is decreased when the energy of the signal that is picked up is dominated by the energy of the background noise and/or of the speech of the remote speaker.

After anti-echo processing by the block 38, the signal picked up by the physiological sensor 18 is used as an input signal to a block 44 for calculating a cutoff frequency FC.

The following step consists in performing signal filtering with a lowpass filter 48 for the signal from the physiological sensor 18 and with respective highpass filters 50, 52 for the signals picked up by the microphones 20 and 22.

These filters 48, 50, 52 are preferably digital filters of the incident impulse response (IIR) type, i.e. recursive filters, that present a relatively abrupt transition between the passband and the stop band.

Advantageously, these filters are adaptive filters with a cutoff frequency that is variable and determined dynamically by the block 44.

This makes it possible to adapt the filtering to the particular conditions in which the headset is being used: more or less high voice of the speaker when speaking, more or less close coupling between the physiological sensor 18 and the wearer's cheek or temple, etc. The cutoff frequency FC, which is preferably the same for the lowpass filter 48 and the highpass filters 50 and 52, is determined from the signal from the physiological sensor 18 after the anti-echo processing 38. For this purpose, an algorithm calculates the signal-to-noise ratio over a plurality of frequency bands situated in a range extending for example from 0 to 2500 Hz (the level of noise being given by an energy calculation in a highest frequency band, e.g. in the range 3000 Hz to 4000 Hz, since it is known that in this zone the signal can be made up only of noise, given the properties of the components that constitute the physiological sensor 18). The cutoff frequency that is selected corresponds to the maximum frequency at which the signal-to-noise ratio exceeds a predetermined threshold, e.g. 10 decibels (dB).

The following step consists in using the block 54 to perform mixing so as to reconstruct the complete spectrum with both a low frequency region of the spectrum given by the filtered signal from the physiological sensor 18 and a high frequency portion of the spectrum given by the filtered signal from the microphones 20 and 22 after passing through a combiner-and-phaseshifter 56 that enables denoising to be performed in this portion of the spectrum. This reconstruction is performed by summing the two signals that are applied synchronously to the mixer block 54 so as to avoid any deformation.

There follows a more precise description of the manner in which the noise reduction is performed by the combiner-and-phaseshifter 56.

The signal that it is desired to denoise (i.e. the signal from the near speaker and situated in the high portion of the spectrum, typically frequency components above 1500 Hz) comes from the two microphones 20 and 22 that are placed a few centimeters apart from each other on the shell 14 of one of the earpieces of the headset. As mentioned above, these two microphones are arranged relative to each other in such a manner that the direction 24 they define points approximately towards the mouth 26 of the wearer of the headset. As a result, the speech signal delivered by the mouth reaches the front microphone 20 and then reaches the rear microphone 22 with a delay and thus a phase shift that is substantially constant, whereas ambient noise is picked up by both microphones 20 and 22 without phase shifts (which microphones are omnidirectional microphones), given the remoteness of the sources of interfering noise from the two microphones 20 and 22.

The noise in the signals picked up by the microphones 20 and 22 is not reduced in the frequency domain (as is often the case), but rather in the time domain, by means of the combiner-and-phaseshifter 56 that comprises a phaseshifter 58 that applies a delay $\tau$ to the signal from the rear microphone 22 and a combiner 60 that enables the domain signal to be subtracted from the signal coming from the front microphone 20.

This constitutes a first order differential microphone array that is equivalent to a single virtual microphone of directivity that can be adjusted as a function of the value of $\tau$, over the range $0 \leq \tau \leq \tau_A$ (where $\tau_A$ is a value corresponding to the natural phase shift between the two microphones 20 and 22, equal to the distance between the two microphones divided by the speed of sound, i.e. a delay of about 30 microseconds (μs) for a spacing of 1 centimeter (cm)). A value $\tau=\tau_A$ gives a cardioid directivity pattern, a value $\tau=\tau_A/3$ gives a hypercardioid pattern, and a value $\tau=0$ gives a bipolar pattern. By appropriately selecting this parameter, it is possible to obtain attenuation of about 6 dB for diffuse surrounding noise. For more details on this technique, reference may be made for example to:

[1] M. Buck and M. Röβler, "First order differential microphone arrays for automotive applications", Proceedings of the 7th International Workshop on Acoustic on Echo and Noise Control (IWAENC), Darmstadt, Sep. 10-13, 2001.

There follows a description of the processing performed on the overall signal (high and low portions of the spectrum) output from the mixer means 54.

This signal is subjected by a block 62 to frequency noise reduction.

This frequency noise reduction is preferably performed differently in the presence or in the absence of speech, by evaluating the probability p that speech is absent from the signals picked up by the physiological sensor 18.

Advantageously, this possibility that speech is absent is derived from the information given by the physiological sensor.

As mentioned above, the signal delivered by this sensor presents a very good signal-to-noise ratio up to the cutoff frequency FC as determined by the block 44. However above the cutoff frequency its signal-to-noise ratio still remains good, and is often better than that from the microphones 20 and 22. The information from the sensor is used by a block 64 that calculates the frequency intercorrelation between the combined signal delivered by the mixer block 54 and the non-filtered signal from the physiological sensor, prior to lowpass filtering 48.

Thus, for each frequency f, e.g. in the range FC to 4000 Hz, and for each frame n, the following calculation is performed by the block 64:

$$InterCorrelation(n, f) = \alpha_{intercorr} * InterCorrelation(n-1, f) + (1-\alpha_{Intercorr}) * \overrightarrow{Smix(f)} \cdot \overrightarrow{Saac(f)}$$

where Smix(f) and Saac(f) are (complex) vector representations of frequency for the frame n, respectively of the combined signal delivered by the mixer block 54 and for the signal from the physiological sensor 18.

In order to evaluate the probability of that speech is absent, the algorithm searches for the frequencies for which there is only noise (the situation that applies when speech is absent): on the spectrum diagram of the signal delivered by the mixer block 54 certain harmonics are buried in noise, whereas they stand out more in the signal from the physiological sensor.

Figure 3:
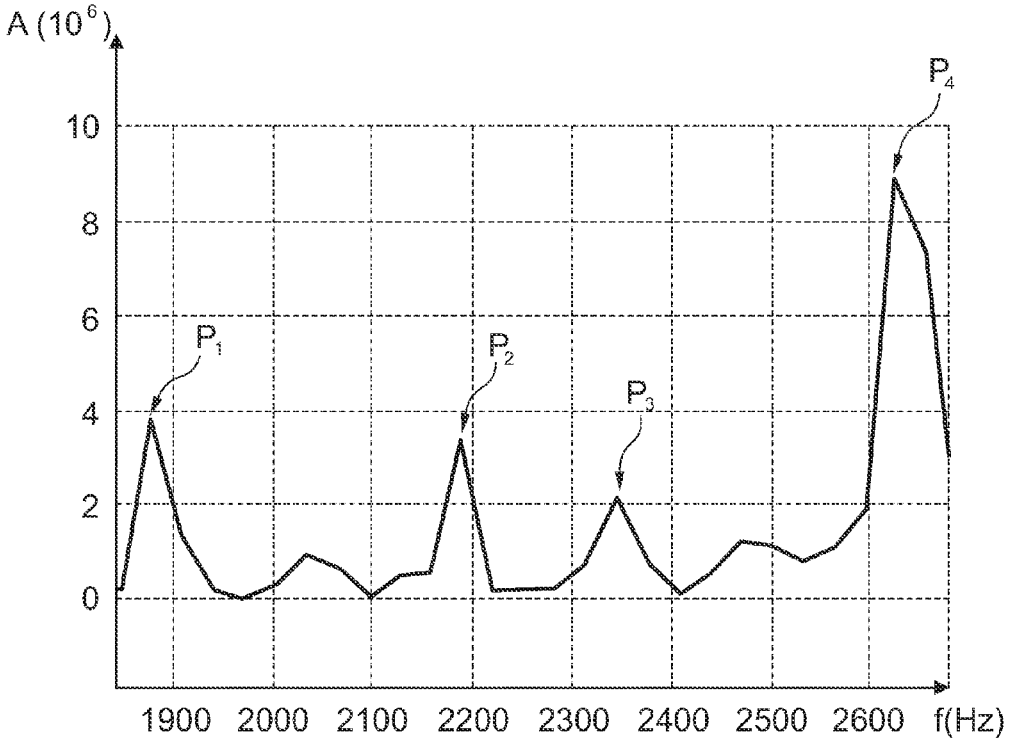
FIG. 3 is an amplitude/frequency spectrum diagram showing the intercorrelation calculation used for evaluating the probability of speech being present.

Calculating intercorrelation using the above-described formula produces a result in a frequency domain, with FIG. 3 showing an example.

The peaks $P_1$, $P_2$, $P_3$, $P_4$, . . . in the intercorrelation calculation indicate strong correlation between the combined signal delivered by the mixer block 54 and the signal from the physiological sensor 18, such that the emergence of such correlated frequencies indicates that speech is probably present for both frequencies.

In order to obtain the probability that speech is absent (block 66), consideration is given to the following complementary value:

$$AbsProba(n,f)=1-InterCorrelation(n,1)/normalization_coefficient$$

The value of normalization_coefficient enables the probability distribution to be adjusted as a function of the value of the intercorrelation, so as to obtain values in the range 0 to 1.

The probability p that speech is absent as obtained in this way is applied to the block 62 that acts on the signal delivered by the mixer block 54 to perform frequency noise reduction in selective manner relative to a given threshold for the probability that speech is absent:

- if it is probable that speech is absent, the noise reduction is applied to all of the frequency bands, i.e. the maximum reduction gain is applied in the same manner to all of the components of the signal (since under such circumstances it very likely does not contain any useful components); and
- in contrast, in the probable presence of speech, the noise reduction is frequency noise-reduction applies selectively in different frequency bands as a function of the value p of the probability that speech is present, in application of a conventional scheme, e.g. comparable to that described in WO 2007/099222 A1 (Parrot).

The above-described system enables excellent overall performance to be obtained, typically with noise reduction of the order of 30 dB to 40 dB in the speech signal from the near speaker. Because all interfering noise is eliminated, in particular the most intrusive noise (train, subway, etc.), which is concentrated at low frequencies, gives the remote listener (i.e. the party with whom the wearer of the headset is in communication) the impression that the other party (the wearer of the headset) is in a silent room.

Finally, it is advantageous to apply final equalization to the signal, in particular in the lower portion of the spectrum, by means of a block 68.

The low frequency content picked up from the cheek or the temple by the physiological sensor 18 is different from the low frequency content of the sound coming from the user's mouth, as it would be picked up by a microphone situated a few centimeters from the mouth, or even as it would be picked up by the ear of a listener.

The use of the physiological sensor and of the above-described filtering does indeed make it possible to obtain a signal that is very good in terms of signal/noise ratio, but that may present the listener with a timbre that is rather dead and unnatural.

In order to mitigate that difficulty, it is advantageous to perform equalization of the output signal using gains that are adjusted selectively on different frequency bands in the region of the spectrum that corresponds to the signal picked up by the physiological sensor. Equalization may be performed automatically, from the signal delivered by the microphones 20 and 22 before filtering.

Figure 4:
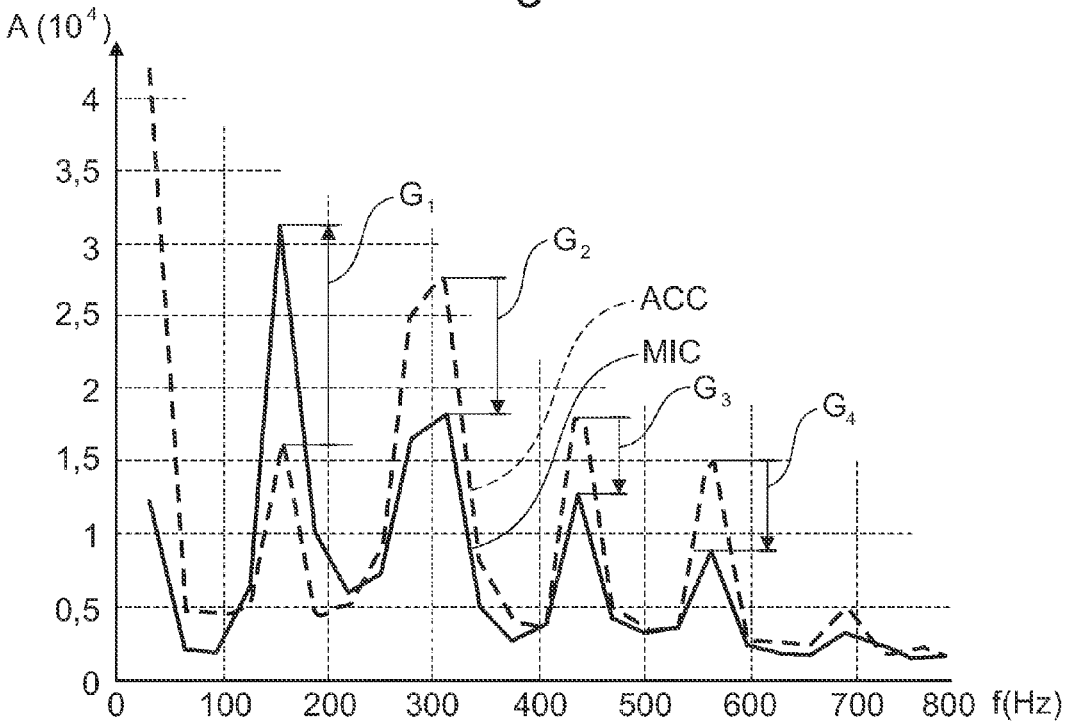
FIG. 4 is an amplitude/frequency spectrum diagram showing the final automatic equalization processing operated after noise reduction.

FIG. 4 shows an example in the frequency domain (but after a Fourier transform) of the signal ACC produced by the physiological sensor 18 compared with a microphone signal MIC as would be picked up a few centimeters from the mouth.

In order to optimize the rendering of the signal picked up by the physiological sensor, different gains $G_1$, $G_2$, $G_3$, $G_4$, . . . are applied to different frequency bands of the low frequency portion of the spectrum.

These gains are evaluated by comparing signals picked up in common frequency bands both by the physiological sensor 18 and by the microphones 20 and/or 22.

More precisely, the algorithm calculates the respective Fourier transforms of those two signals, giving a series of frequency coefficients (expressed in dB) NormPhysioFreq_dB(i) and NormMicFreq_dB(i), corresponding respectively to the absolute value or "norm" of the $i^{th}$ Fourier coefficient of the signal from the physiological sensor and to the norm of the $i^{th}$ Fourier coefficient of the microphone signal.

For each frequency coefficient of rank i, if the difference:

$$\text{DifferenceFreq_dB}(i)=\text{NormPhysioFreq_dB}(i)-\text{NormMicFreq_dB}(i)$$

is positive, then the gain that is applied will be less than unity (negative in terms of dB); and conversely if the difference is negative then the gain to be applied is greater than unity (positive in dB).

If the gain were to be applied as such, the differences would not be exactly constant from one frame to another, in particular when handling sounds other than voice sounds, so there would be large variations in the equalization of timbre. In order to avoid such variations, the algorithm performs smoothing of the difference, thereby enabling the equalization to be refined:

$$\text{Gain_dB}(i)=\lambda.\text{Gain_dB}(i)-(1-\lambda)\text{DifferenceFreq_dB}(i)$$

The closer the coefficient $\lambda$ is to 1, the less account is taken of the information from the current frame in calculating the gain of the $i^{th}$ coefficient. Conversely, the closer the coefficient $\lambda$ is to 0, the greater the account that is taken of the instantaneous information. In practice, for the smoothing to be effective, a value of $\lambda$ is adopted that is close to 1, e.g. $\lambda=0.99$. The gain applied to each frequency band of the signal from the physiological sensor then gives, for the $i^{th}$ modified frequency:

$$\text{NormPhysioFreq_dB_corrected}(i)=\text{NormPhysioFreq_dB}(i)+\text{Gain_dB}(i)$$

It is this norm that is used by the equalization algorithm.

Applying different gains serves to make the speech signal more natural in the lower portion of the spectrum. A subjective study has shown that in a silent environment and when such equalization is applied, the difference between a reference microphone signal and the signal produced by the physiological sensor in the low portion of the spectrum is practically imperceptible.

What is claimed is:

1. An audio headset of the combined microphone and earphone type, the headset comprising:

two earpieces each including a transducer for sound reproduction of an audio signal;

a physiological sensor suitable for coming into contact with the cheek or the temple of the wearer of the headset so as to be coupled thereto and pick up non-acoustic voice vibration transmitted by internal bone conduction, the physiological sensor delivering a first speech signal;

a microphone set comprising at least one microphone suitable for picking up acoustic voice vibration transmitted by air from the mouth of the wearer of the headset, said microphone set delivering a second speech signal; and mixer means for combining the first and second speech signals and for outputting a third speech signal representative of the speech uttered by the wearer of the headset;

wherein:

the physiological sensor is incorporated in an ear-surrounding cushion of a shell of one of the earpieces;

the set of microphones comprises two microphones placed on the shell of one of the earpieces;

the two microphones are in alignment to form a linear array in a main direction pointing towards the mouth of the wearer of the headset; and means are provided for reducing the non-frequency noise of the second speech signal, said means comprising a combiner suitable for applying a delay to the signal delivered by one of the microphones and for subtracting from said delay signal the signal delivered by the other microphone in such a manner as to remove noise from the near speech signal uttered by the wearer of the headset.

2. The audio headset of claim 1, further comprising:

lowpass filter means for filtering the first speech signal before it is combined by the mixer means, and/or highpass filter means for filtering the second speech signal before it is denoised and combined by the mixer means, these lowpass and/or highpass filter means comprising filters of adjustable cutoff frequency; and cutoff frequency calculation means operating as a function of the signal delivered by the physiological sensor.

3. The audio headset of claim 2, wherein the cutoff frequency calculation means comprise means for analyzing the spectral content of the signal delivered by the physiological sensor, and suitable for determining the cutoff frequency as a function of the relative levels of the signal-to-noise ratios as evaluated in a plurality of distinct frequency bands of the signal delivered by the physiological sensor.

4. The audio headset of claim 1, further comprising:

means for denoising the third speech signal delivered by the mixer means, and operating by frequency noise-reduction.

5. The audio headset of claim 4, further comprising means receiving as input said first and third speech signals and performing intercorrelation between them, and delivering as output a signal representative of the probability of speech being present as a function of the result of said intercorrelation.

6. The audio headset of claim 5, wherein the means for denoising the third speech signal receive as input said signal representative of the probability that speech is present, and they are suitable selectively for:

i) performing noise reduction differently in different frequency bands as a function of the value of said signal representing the probability that speech is present; and ii) performing maximum noise reduction in all frequency bands in the absence of speech.

7. The audio headset of claim 1, further comprising:

post-processing means suitable for performing equalization selectively in different frequency bands in the portion of the spectrum corresponding to the signal picked up by the physiological sensor.

8. The audio headset of claim 7, wherein the post-processing means are suitable for determining an equalization gain for each of said frequency bands, said gain being calculated on the basis of the respective frequency coefficients of the signals delivered by the microphone(s) and the signals delivered by the physiological sensor, as considered in the frequency domain.

9. The audio headset of claim 8, wherein the post-processing means are also suitable for performing smoothing of said calculated equalization gain over a plurality of successive signal frames.

* * * * *